US007207341B2

(12) United States Patent
Cantave et al.

(10) Patent No.: US 7,207,341 B2
(45) Date of Patent: Apr. 24, 2007

(54) DISHWASHER WITH SHIELDED DISPENSER

(75) Inventors: Herve J. Cantave, Jackson, TN (US); James H. Raudabaugh, Jackson, TN (US)

(73) Assignee: Maytag Corporation, Newton, IA (US)

( * ) Notice: Subject to any disclaimer, the term of this patent is extended or adjusted under 35 U.S.C. 154(b) by 545 days.

(21) Appl. No.: 10/645,573

(22) Filed: Aug. 22, 2003

(65) Prior Publication Data

US 2005/0039778 A1 Feb. 24, 2005

(51) Int. Cl.
*B08B 3/00* (2006.01)

(52) U.S. Cl. ..... 134/56 D; 134/57 D; 134/58 D; 134/93; 134/200; 134/201; 222/651

(58) Field of Classification Search ..... 134/57 D, 134/56 D, 58 D, 93, 201; 222/651
See application file for complete search history.

(56) References Cited

U.S. PATENT DOCUMENTS 3,019,802 A * 2/1962 Mercer ..... 134/95.1
3,028,051 A 4/1962 Jacobs
3,144,031 A 8/1964 Long
3,289,896 A * 12/1966 Cushing ..... 222/154
3,344,957 A 10/1967 Duncan et al.
3,402,853 A 9/1968 Perl
3,406,695 A 10/1968 Perl
3,850,185 A * 11/1974 Guth ..... 134/58 DL
4,984,596 A 1/1991 Westfelt
5,033,659 A * 7/1991 Marks et al. ..... 222/651
5,133,487 A 7/1992 Russi
D352,578 S 11/1994 Mooney et al.
5,603,431 A 2/1997 Tuller
D393,333 S 4/1998 Kibler et al.
5,884,821 A 3/1999 Wilhelmstaetter et al.

FOREIGN PATENT DOCUMENTS

EP 000190795 8/1986
FR 002593379 7/1987

* cited by examiner

*Primary Examiner*—M. Kornakov
(74) *Attorney, Agent, or Firm*—Diederiks & Whitelaw PLC

(57) ABSTRACT

In a dishwasher having a washing chamber capable of accommodating upper and lower racks, a detergent dispensing assembly includes a housing defining a compartment for receiving detergent. A lid is pivotally connected to the housing for selectively pivoting between closed and dispensing positions. A shield, which is spaced away from the lid, extends in front of the lid to ensure that an object within the washing chamber does not prevent the lid from freely moving between the closed and dispensing positions during a wash cycle.

17 Claims, 3 Drawing Sheets

DISHWASHER WITH SHIELDED DISPENSER

BACKGROUND OF THE INVENTION

1. Field of the Invention

The present invention pertains to the art of dishwashers and, more particularly, to a shield for a detergent dispenser of a dishwasher.

2. Discussion of the Prior Art

Many dishwashers include a dispenser having a lid that swings open to release detergent at a specific time during a dishwasher cycle. The dispenser is often located on an interior side of a dishwasher door. While this position allows for convenient filling of the dispenser, large objects within the dishwasher may obstruct the opening of the dispenser lid. For example, if a utensil positioned in a silverware basket of the dishwasher is pressed against the dispenser door when it is set to open, the detergent will not be released such that the dishes will not be adequately cleaned.

Based on the above, there exists a need to avoid obstructing the opening of a dishwasher dispenser door. More preferably, there is a need for an improved dishwasher dispenser that protects the dispenser lid from being obstructed by objects within the washing chamber of the dishwasher.

SUMMARY OF THE INVENTION

The present invention is directed to a dishwasher having a washing chamber capable of accommodating upper and lower racks and a dispensing assembly including a housing defining a compartment for receiving detergent. A lid is pivotally connected to the housing for movement between a closed position in which the detergent compartment is covered, and a dispensing position in which the detergent compartment is at least partially exposed. Further, a shield extends in front of the lid to ensure that objects, such as tall utensils placed in a silverware basket within the washing chamber, do not prevent the lid from freely moving between the closed and dispensing positions during a wash cycle.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
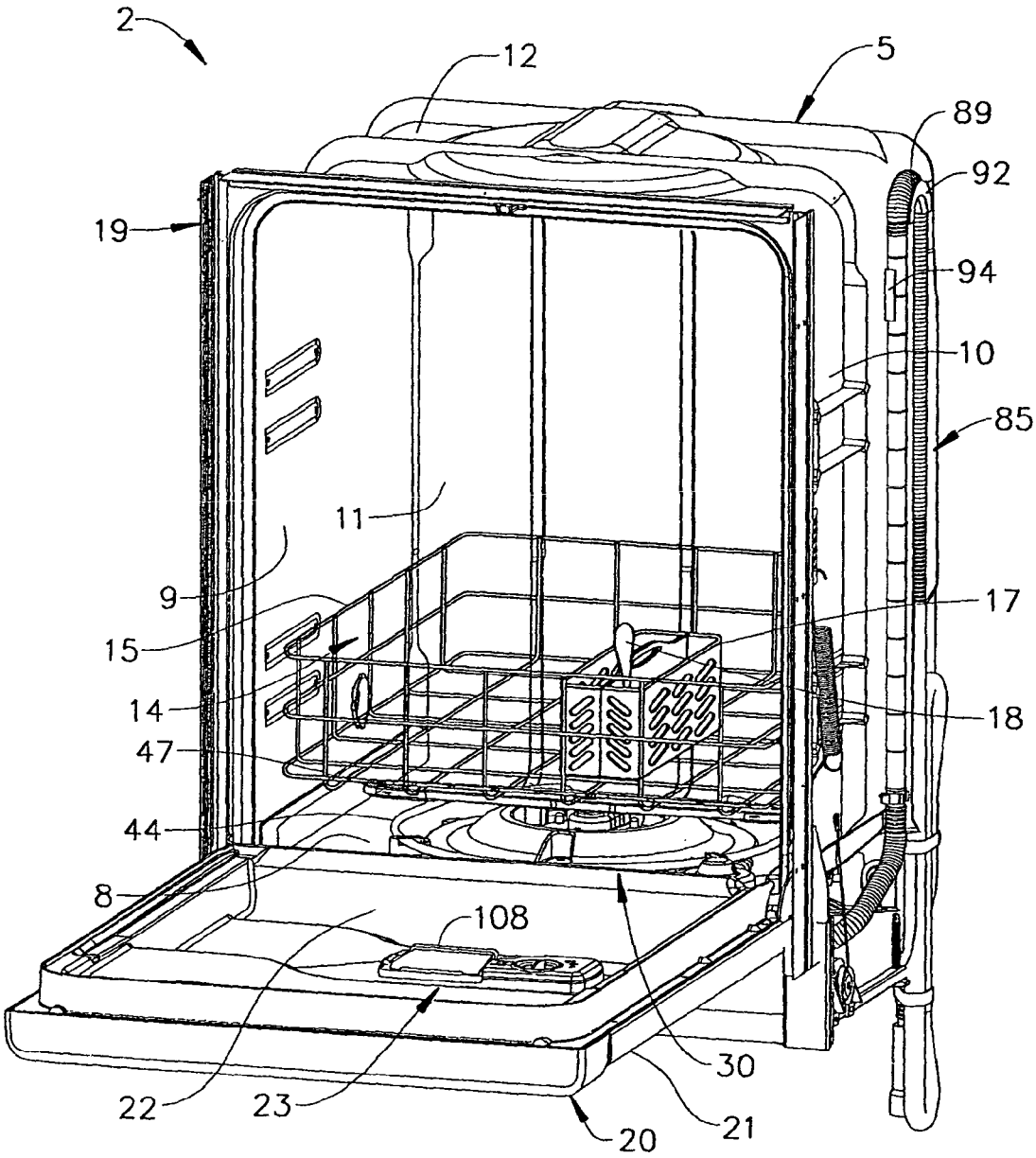
FIG. 1 is a perspective view of a dishwasher incorporating a dispensing assembly constructed in accordance with the present invention.

With initial reference to FIG. 1, a dishwasher constructed in accordance with the present invention as generally indicated at 2. As shown, dishwasher 2 includes a tub 5 which is preferably injection molded of plastic so as to include integral bottom, side, rear and top walls 8–12 respectively. Within the confines of walls 8–12, tub 5 defines a washing chamber 14 within which soiled kitchenware is adapted to be placed upon shiftable upper and lower racks (the lower rack being indicated at 15), with the kitchenware being cleaned during a washing operation in a manner widely known in the art. As shown in this figure, a utensil basket 17, which contains a utensil 18, is preferably positioned within lower rack 15. Tub 5 has associated therewith a frontal portion 19 at which is pivotally supported a door 20 used to seal chamber 14 during a washing operation. Door 20 has an exterior panel 21 and an interior panel 22 preferably provided with a dispensing assembly 23 within which a consumer can place liquid or particulate washing detergent for dispensing at predetermined periods of the washing operation.

Disposed within tub 5 and, more specifically, mounted within a central opening formed in bottom wall 8 of tub 5, is a pump and filter assembly 30. Extending about a substantial portion of pump and filter assembly 30, at a position raised above bottom wall 8, is a heating element 44. In a manner known in the art, heating element 44 preferably takes the form of a sheath, electric resistance-type heating element. In general, pump and filter assembly 30 is adapted to direct washing fluid to a lower wash arm 47 and an upper wash arm (not shown). Dishwasher 2 has associated therewith a drain hose 85 including at least one corrugated or otherwise curved portion 89 that extends about an arcuate hanger 92 provided on an outside surface of side wall 10. Drain hose 85 is also preferably secured to tub 5 through various clips, such as that indicated at 94. In any event, in this manner, an upper loop is maintained in drain hose 85 to assure proper drainage in a manner known in the art. Actually, a detailed description of the exact structure and operation of pump and filter assembly 30 of dishwasher 2 does not form part of the present invention, but is rather set forth in pending U.S. application Ser. No. 10/186,739 entitled "Dishwasher Pump and Filtration System" filed Jul. 2, 2002, incorporated herein by reference.

Figure 2:
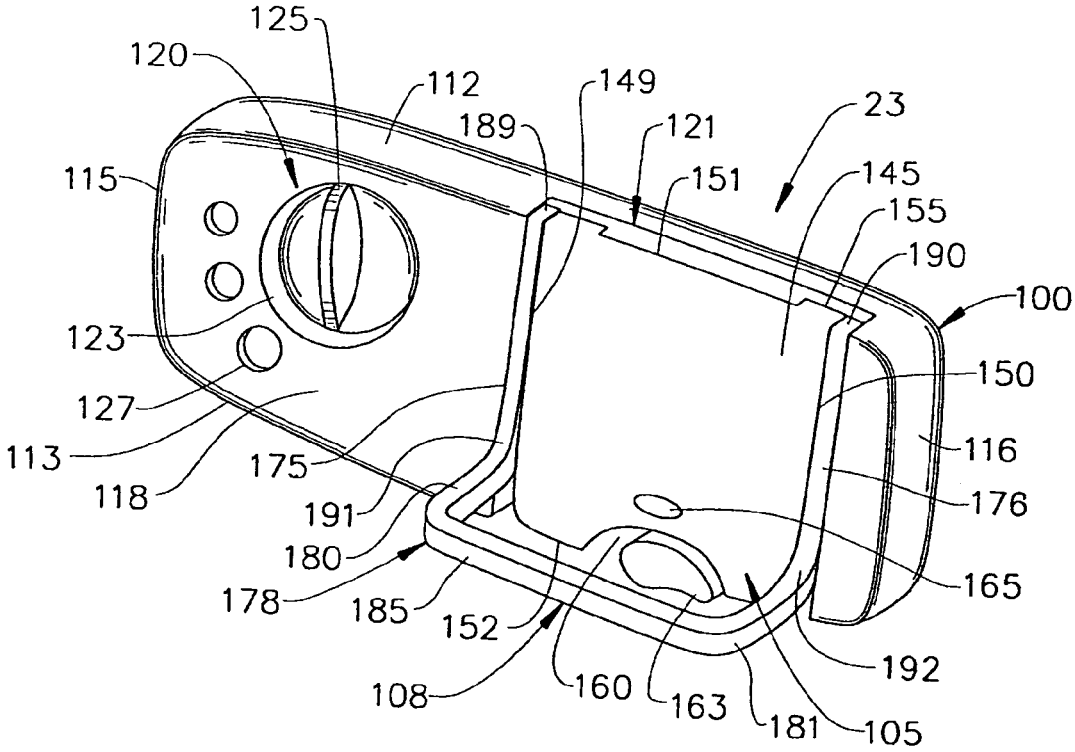
FIG. 2 is a perspective view of the dispensing assembly shown in FIG. 1, with a lid thereof shown in a closed position and a shield member shown in a shielding position.
Figure 3:
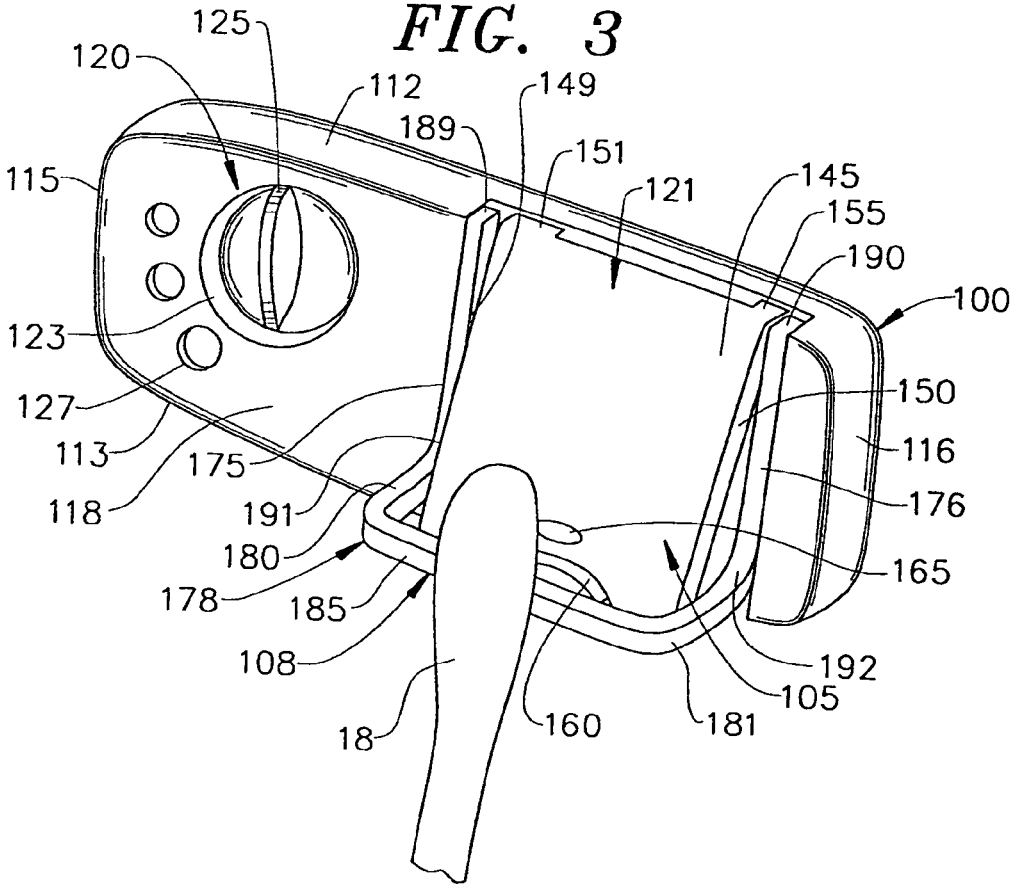
FIG. 3 is a perspective view of the dispensing assembly of the present invention, with the lid shown in a dispensing position and the shield member shown in the shielding position.
Figure 4:
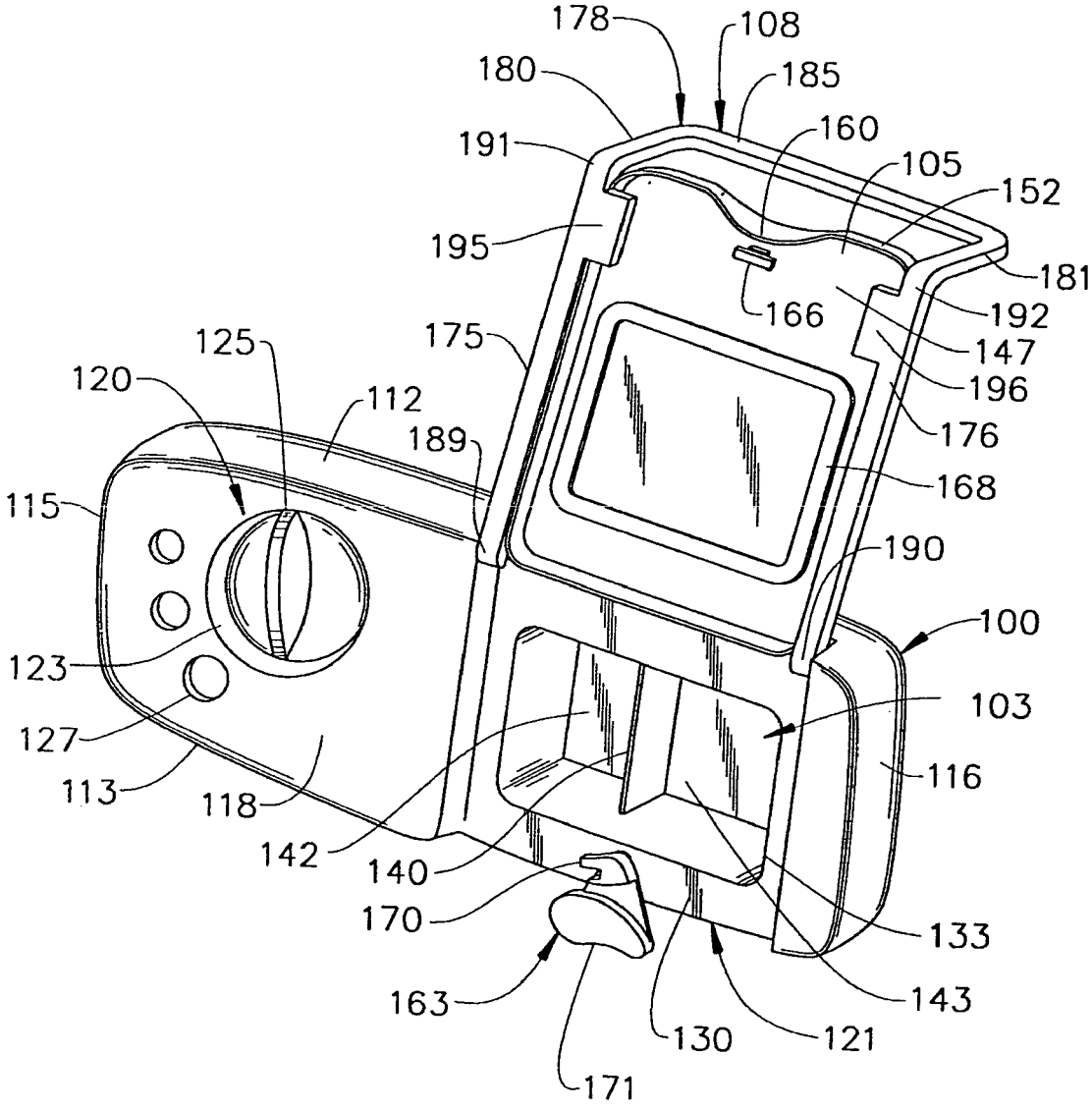
FIG. 4 is a perspective view of the dispensing assembly of the present invention, with the lid shown in a fully open position and the shield member shown in a loading position.

Instead, the present invention is directed to particulars of dispensing assembly 23 of dishwasher 2. Dispensing assembly 23 is actually located on interior panel 22 in a position so as to be generally adjacent to utensil basket 17 when door 20 is in a closed position. As best shown in FIGS. 2–4, dispensing assembly 23 includes a housing 100, a detergent compartment 103, a lid 105, and a shield member 108. Shield member 108 acts to prevent objects in washing chamber 14, such as utensil 18 within utensil basket 17, from interfering with the movement of lid 105 during a wash cycle. Shield member 108 may also prevent other kitchenware items, such as pots or pans, from interfering with the movement of lid 105 as will become fully evident below.

Housing 100 is preferably integrally molded within interior panel 21. However, housing 100 may also be a separate piece which is connected to interior panel 21 by any suitable attachment means. In the embodiment shown, housing 100 includes an upper edge 112, a lower edge 113, two side edges 115 and 116, and a front surface 118. Further, housing 100 includes a rinse aid portion 120 and a detergent dispensing portion 121. As shown, rinse aid portion 120 is located adjacent to side edge 115 and detergent dispensing portion 121 is located adjacent to side edge 116. Generally, rinse aid portion 120 includes a fill hole 123 into which rinse aid is poured, a cap 125 for closing fill hole 123, and level indicator windows 127 for indicating the amount of rinse aid that has been added to rinse aid portion 120. Rinse aid portion 120 is actually known in the art and has been included only for the sake of completeness. Rather, the invention is directed to detergent dispensing portion 121 which includes detergent compartment 103, lid 105, and shield member 108.

As previously described, shield member 108 ensures that lid 105 is not obstructed from opening to release detergent from detergent compartment 103 during a wash cycle. As best shown in FIG. 4, a recessed portion 130 of housing 100 provides a foundation for detergent compartment 103 within housing 100. Recessed portion 130 forms a border 133 around detergent compartment 103. Lid 105 and shield member 108 contact recessed portion 130 when in closed and shielding positions, respectively. Detergent compartment 103 also includes a separator wall 140 for dividing compartment 103 into first and second sections 142 and 143. First and second sections 142 and 143 are sized to assist a user in measuring the amount of detergent added to compartment 103.

Lid 105 is pivotally connected to housing 100 for selectively opening and closing detergent compartment 103. Lid 105 includes a front surface 145, a back surface 147, side edges 149 and 150, a top edge 151 and a bottom edge 152. Top edge 151 includes spaced hinges, one of which is indicated at 155, for attaching lid 105 to upper edge 112 of housing 100. Hinges 155 include springs (not shown) for biasing lid 105 to an open or dispensing position in a manner known in the art. Bottom edge 152 of lid 105 includes a cut-away portion 160 which provides a space for a latch 163 for selectively locking or releasing lid 105, as will be discussed below. Further, an indent 165 appears on front surface 145 of lid 105 where a protrusion 166 extends from back surface 147. Back surface 147 of lid 105 is also equipped with a sealing rim 168 for sealing against border 133 surrounding detergent compartment 103.

For selectively locking or releasing lid 105, latch 163 is rotatably attached to recessed portion 130 adjacent to lower edge 113 of housing 100. Latch 163 includes a first portion 170 and a second portion 171. First portion 170 of latch 163 constitutes a hook-like member adapted to engage protrusion 166 located on back surface 147 of lid 105. Second portion 171 of latch 163 may be depressed by a user's finger (not shown) to rotate latch 163, thereby disengaging first portion 170 from protrusion 166. More specifically, when a user pushes second portion 171 downward, latch 163 rotates such that first portion 170 moves in an arc-like path away from protrusion 166, thereby disengaging latch 163.

Lid 105 is movable between a closed position, a partially open or dispensing position, and a fully open position as shown in FIGS. 2–4 respectively. In the closed position of FIG. 2, front surface 145 of lid 105 is in alignment with front surface 118 of housing 100. Protrusion 166 on back surface 147 engages first portion 170 of latch 163 to hold lid 105 in the closed position. In the dispensing position represented in FIG. 3, lid 105 is partially open to allow detergent to be dispensed, but detergent compartment 103 is not yet fully exposed. In order to ensure that lid 105 can freely move between the closed position and the dispensing position, dispensing assembly 23 specifically cooperates with shield member 108. More specifically, shield member 108 includes two side legs 175 and 176 which extend substantially parallel to side edges 149 and 150 of lid 105 as shown in FIG. 2 wherein lid 105 is in a closed position and shield member 108 is in a shielding position. Shield 108 also includes a U-shaped portion 178 which is formed from two outwardly extending legs 180 and 181 and a cross member 185. Each of side legs 175 and 176 includes a first end 189, 190 and a second end 191, 192, respectively. First ends 189 and 190 are hinged to housing 100 on a common axis with hinges 155 of lid 105. With this construction, shield member 108 is movable between a shielding position (FIG. 2) and a loading position (FIG. 4). In the shielding position, cross member 185 extends across front surface 145 of dispenser lid 105 and is spaced apart from lid 105 to provide lid 105 with unobstructed movement between the closed and dispensing positions. In reaching the dispensing position shown in FIG. 3, front surface 145 of lid 105 abuts shield member 108. At this point, it should be readily apparent that any kitchenware, such as utensil 18 in basket 17, which might obstruct the movement of lid 105, would abut shield member 108 such that lid 105 is free to move at least to the dispensing position of FIG. 3. If unobstructed, the biasing of lid 105 will preferably cause both lid 105 and shield member 108 to shift to the fully open position of FIG. 4 to enable complete flushing of detergent compartment 103.

Although lid 105 opens enough in the dispensing position of FIG. 3 to allow detergent within the detergent compartment 103 to escape, this position does not allow for easy filling of detergent compartment 103. Therefore, lid 105 is also movable to a fully open position in which detergent compartment 103 is completely exposed as shown in FIG. 4. In this position, liquid or solid detergent may be easily added to detergent compartment 103. In accordance with the most preferred embodiment of the invention, adjacent to ends 191 and 192, side legs 175 and 176 include integrally formed tabs 195 and 196. Tabs 195 and 196 extend across respective portions of lid 105 such that shield member 108 is held in the shielding position when lid 105 is in a closed position.

The method of operating dispensing assembly 23 is detailed below. Before a washing cycle begins, lid 105 and shield member 108 are rotated to their fully open and loading positions, respectively, as shown in FIG. 4. Granulated or liquid detergent is placed within first and/or second sections 142, 143 of detergent compartment 103 and lid 105 and shield member 108 are pivoted to their closed and shielding positions, as shown in FIG. 2. Optionally, rinse aid is added to rinse aid portion 120 by removing cap 125 and pouring rinse aid into fill hole 123 until a desirable level has been reached, as indicated through level indicator windows 127. In moving to the closed position, lid 105 causes first portion 170 of latch 163 to engage protrusion 166 on back surface 147 of lid 105. By latching lid 105 in the closed position, shield member 108 is secured in its shielding position due to tabs 195 and 196, which are located under lid 105 when lid 105 is in its closed position.

At some predetermined time after the washing cycle begins, first portion 170 of latch 163 is automatically moved out of engagement with protrusion 166 of lid 105, thereby permitting lid 105 to pivot upward out of closing relationship with detergent compartment 103 and into a dispensing position as shown in FIG. 3. The contents of detergent compartment 103 are thus released into washing chamber 14. Shield member 108 ensures that detergent will be dispensed by providing a space between door 105 and shield member 108 so that lid 105 may unobstructably move from the closed position to at least this dispensing position. Specifically, cross member 185 of shield member 108 guards lid 105 from interference by objects within washing chamber 14. Therefore, the risk of lid 105 not pivoting to a dispensing position of FIG. 3 is eliminated. Once lid 105 has traveled to the dispensing position, shield member 108 and lid 105 may pivot in unison to the fully open position during the wash cycle as front surface 145 of lid 105 abuts cross member 185 of shield member 108 when latch 163 is released and lid 105 moves to the dispensing position. That is, the force of the springs (not shown) at hinges 155 biases lid 105 and shield member 108 to move beyond the dispensing position of FIG. 3 to the fully open position of FIG. 4 to allow flushing of detergent compartment 103 during a wash cycle and re-filling of detergent compartment 103 in a subsequent cycle.

Although described with reference to a preferred embodiment of the invention, it should be readily understood that various changes and/or modifications can be made to the invention without departing from the spirit thereof. For instance, different shield structure may be used while still performing a shielding function by protecting the dispenser from utensils, pots, pans or the like. In addition, various types of latch mechanisms may be employed to hold the door and shield in the closed position. The utensil basket may also be positioned on or formed as part of the inner dishwasher door panel. Furthermore, the shield member may be constituted by a fixed member mounted to an area within the washing chamber or on the interior panel, rather than being mounted to the housing of the dispensing assembly, wherein the lid could still be protected but could pivot past the shield. In general, the invention is only intended to be limited by the scope of the following claims.

We claim:

1. In a dishwasher including a tub defining a washing chamber accommodating a shiftable rack, and a door, having an interior panel, pivotally mounted to the tub for selectively accessing the washing chamber, a dispensing assembly comprising:

a housing provided on the interior panel and defining a detergent compartment for receiving detergent;

a lid pivotally mounted for movement between a closed position in which the detergent compartment is covered and a dispensing position in which the detergent compartment is exposed; and a shield member carried by the door, said shield member being spaced from and extending across at least a portion of the lid to assure the lid is not obstructed by kitchenware in the dishwasher when moving from the closed position to the dispensing position during a wash cycle.

2. The dispensing assembly according to claim 1, wherein the shield member includes leg portions extending away from the lid and a cross portion which interconnects the leg portions at a position spaced from a front surface of the lid.

3. The dispensing assembly according to claim 2, wherein the leg portions and the cross portion form a U-shaped member that extends about the detergent compartment.

4. The dispensing assembly according to claim 1, wherein the lid and shield member are movable to a fully open position for loading of the detergent compartment.

5. The dispensing assembly according to claim 4, wherein the shield member and the lid pivot about a common axis.

6. The dispensing assembly according to claim 1, further comprising a latch for retaining the lid and shield member in the closed position.

7. In a dishwasher including a tub defining a washing chamber accommodating a shiftable rack, and a door, having an interior panel, pivotally mounted to the tub for selectively accessing the washing chamber, a dispensing assembly comprising:

a housing provided on the interior panel and defining a detergent compartment for receiving detergent;

a lid pivotally mounted for movement between a closed position in which the detergent compartment is covered and a dispensing position in which the detergent compartment is exposed; and a shield member being spaced from and extending across at least a portion of the lid to assure the lid is not obstructed by kitchenware in the dishwasher when moving from the closed position to the dispensing position during a wash cycle, wherein the shield member is mounted for pivotal movement relative to the housing between a shielding position and a loading position.

8. The dispensing assembly according to claim 7, wherein the shield member further includes tabs which are positioned beneath the lid when the lid is in the closed position for holding the shield member in its shielding position.

9. A dishwasher comprising:

a tub defining a washing chamber including an open frontal portion;

at least one rack shiftably mounted within the washing chamber, said at least one rack being adapted to support kitchenware;

a door, including an interior panel, pivotally mounted for movement between a closed condition, wherein the door substantially seals the open frontal portion, and an opened condition, wherein the door is lowered for loading or unloading of the at least one rack;

a dispensing assembly arranged on the interior panel of the door, said dispensing assembly including a detergent compartment and a lid, said lid being movable, relative to the detergent compartment, between a closed position in which the lid substantially seals the detergent compartment, and a dispensing position exposing the detergent compartment; and a shield member mounted to the door, said shield member extending across at least a portion of the dispensing assembly directly adjacent the lid, said shield member providing to lid with unobstructed movement between the closed and dispensing positions.

10. The dishwasher according to claim 9, wherein the shield member includes leg portions extending away from to lid and a cross portion which interconnects the leg portions at a position spaced from a front surface of the lid.

11. The dishwasher according to claim 10, wherein the leg portions and the cross portion form a U-shaped member that extends about the detergent compartment.

12. The dishwasher according to claim 9, wherein the shield member is mounted for pivotal movement relative to the detergent compartment between a shielding position and a loading position.

13. The dishwasher according to claim 9, wherein the lid and shield member are movable to a fully open position for loading of the detergent compartment.

14. The dishwasher according to claim 12, wherein the shield member and the lid pivot about a common axis.

15. The dishwasher according to claim 9, further comprising a latch for retaining the lid and shield member in the closed position.

16. The dishwasher according to claim 14, wherein the shield member further includes tabs, which are positioned beneath the lid when the lid is in the closed position, for holding the shield member in its shielding position.

17. The dishwasher according to claim 9, wherein the shield member is mounted to the dispensing assembly.

* * * * *